US006645082B1

(12) United States Patent
Lessard et al.

(10) Patent No.: US 6,645,082 B1
(45) Date of Patent: Nov. 11, 2003

(54) BOWLING LANE APPARATUS

(75) Inventors: Timothy F. Lessard, Monmouth, ME (US); Marcel C. Gaudreau, Jr., Minot, ME (US)

(73) Assignee: Panolem Industries International Incorporated, Shelton, CT (US)

( * ) Notice: Subject to any disclaimer, the term of this patent is extended or adjusted under 35 U.S.C. 154(b) by 0 days.

(21) Appl. No.: 10/225,646

(22) Filed: Aug. 21, 2002

(51) Int. Cl.[7] ..... A63D 1/04
(52) U.S. Cl. ..... 473/115; 428/99
(58) Field of Search ..... 473/115, 117; 411/399, DIG. 2; 52/396.05, 403.1, 418, 746.1; 470/1, 209; 428/99

(56) References Cited

U.S. PATENT DOCUMENTS

| | | | | | |
|---|---|---|---|---|---|
| 2,039,580 | A | | 5/1936 | Borders | 273/51 |
| 2,383,938 | A | | 9/1945 | MacKenzie | 108/28 |
| 2,493,620 | A | | 1/1950 | Cusano | 273/126 |
| 2,948,000 | A | * | 8/1960 | Borland | 470/209 |
| 3,650,184 | A | | 3/1972 | Kolm et al. | 94/18 |
| 4,059,933 | A | * | 11/1977 | Funk et al. | 52/127.12 |
| 4,146,223 | A | | 3/1979 | Stottman | 273/51 |
| 4,205,842 | A | | 6/1980 | Murrey, Sr. | 273/51 |
| 4,421,309 | A | | 12/1983 | Heddon | 273/51 |
| 4,507,035 | A | * | 3/1985 | Monett | 411/377 |
| 4,653,246 | A | | 3/1987 | Hepler | 52/787 |
| 4,674,745 | A | * | 6/1987 | Speranza | 473/117 |
| 4,779,868 | A | | 10/1988 | Ayre, Jr. | 273/51 |
| 4,860,516 | A | | 8/1989 | Koller et al. | 52/480 |
| 5,183,262 | A | | 2/1993 | Heddon | 273/51 |
| 5,348,513 | A | | 9/1994 | Heddon | 473/117 |
| 5,412,917 | A | | 5/1995 | Shelton | 52/403.1 |
| 5,466,193 | A | | 11/1995 | Hixson | 473/115 |
| 5,549,516 | A | | 8/1996 | Heddon | 473/115 |
| 5,609,000 | A | | 3/1997 | Niese | 52/480 |
| RE35,778 | E | | 4/1998 | Stirling et al. | 428/63 |
| 5,830,168 | A | | 11/1998 | Finnell et al. | 602/24 |
| 5,924,931 | A | | 7/1999 | Morrissey, III | 473/115 |

* cited by examiner

*Primary Examiner*—William M. Pierce
(74) *Attorney, Agent, or Firm*—McCormick, Paulding & Huber LLP

(57) ABSTRACT

A bowling lane is provided that includes one or more lane sections, a plurality of fasteners, and a plurality of plugs. Each of the one or more lane sections includes a first surface, a second surface, and a plurality of attachment sites. In some embodiments, each attachment site has a first bore having a first diameter, a second bore having a second diameter and extending a first axial length, and a third bore having a third diameter and extending a second axial length. The first bore extends between the second surface and the second bore. The second bore extends between the first bore and the third bore. The third bore extends between the second bore and the first surface. The third diameter is greater than the second diameter, and the second diameter is greater than the first diameter. Each of the plurality of fasteners has a shaft and a cap. The cap is sized to fit with the second bore. The fasteners extend through the first bore for engagement with an underlying panel, thereby attaching the lane section to the underlying panel. Each of the plurality of plugs has an axial length and is disposed within one of the third bores.

13 Claims, 2 Drawing Sheets

BOWLING LANE APPARATUS

BACKGROUND OF THE INVENTION

1. Technical Field

This invention relates to bowling lanes in general, and to bowling lane apparatus in particular.

2. Background Information

A bowling lane generally includes an approach end and a pin end. The bowler sends a ball from the approach end toward the pin end. Bowling lanes have traditionally been constructed from strips of hardwood fastened together to form a flat smooth surface. Periodically, the wooden lanes must be sanded and finished to restore the desired flat and smooth surface. To avoid the requisite sanding, bowling lanes today often utilize an upper panel consisting of a laminated product. In a new application, for example, the laminate might be mechanically attached to an underlying substrate. In a resurfacing application, the laminate might be mechanically attached to the top of an existing wooden lane.

Regardless of the application, quality standards dictate that a bowling lane be flat. The method of attachment between the laminate and the underlying substrate is, therefore, critical to the quality of the lane. It is known to screw a top panel to a base panel, countersink the screw, and place a plug within the countersink portion of the hole. One of the problems with existing methods of attachment is that they typically do not provide for the difference in mechanical properties (e.g., thermal expansion) between the laminate and the underlying substrate. Another problem with existing methods of attachment is that the plug that is placed within the countersink hole may or may not be initially or subsequently coplanar with the laminate surface.

What is needed, therefore, is a bowling lane that includes a method of attachment that solves the above-described problems.

DISCLOSURE OF THE INVENTION

According to the present invention, a bowling lane is provided that includes one or more lane sections, a plurality of fasteners, and a plurality of plugs. Each of the one or more lane sections includes a first surface, a second surface, and a plurality of attachment sites. In some embodiments, each attachment site has a first bore having a first diameter, a second bore having a second diameter and extending a first axial length, and a third bore having a third diameter and extending a second axial length. The first bore extends between the second surface and the second bore. The second bore extends between the first bore and the third bore. The third bore extends between the second bore and the first surface. The third diameter is greater than the second diameter, and the second diameter is greater than the first diameter. Each of the plurality of fasteners has a shaft and a cap. The cap is sized to fit with the second bore. The fasteners extend through the first bore for engagement with an underlying panel, thereby attaching the lane section to the underlying panel. Each of the plurality of plugs has an axial length and is disposed within one of the third bores.

An advantage of the present invention is that a bowling lane is provided that permits relative movement between a lane surface and an underlying substrate. The attachment sites within the lane sections permit lateral movement. The first and second diameters are greater than the diameters of the fastener shaft and cap, respectively, thereby allowing lateral movement caused, for example, by thermal expansion.

Another advantage of the present invention is that a bowling lane is provided that includes a flat lane surface. Prior art applications that include a laminate mechanically fastened to an underlying substrate, disclose a plug inserted into a single diameter countersink hole. Even if the countersink holes are uniform depth, it is probable that not all fasteners will be driven to the same axial position within the hole. Hence, a plug that is sized to fill the entire axial length of the hole may be too long if the fastener is not driven far enough. As a result, the plug will undesirably extend above the upper surface of the laminate and will require trimming. If, on the other hand, the plugs are axially undersized to accommodate different fastener depths, it is probable that at least some of the plugs will be inserted too far into the hole and thereby be undesirably below the upper surface of the laminate. The present invention solves this problem by using plugs that have an axial length that is matched with the axial length of the third bore of each attachment site. Hence, the plugs can be inserted uniformly to maintain the desired flat surface. In some embodiments, the plugs consist of a polymeric material. The materials properties of the polymeric plug facilitate a press fit and retention within a bore, and thereby provide improved service compared to commonly used plugs.

These and other objects, features, and advantages of the present invention will become apparent in light of the detailed description of the present invention.

DETAILED DESCRIPTION OF THE INVENTION

Figure 1:
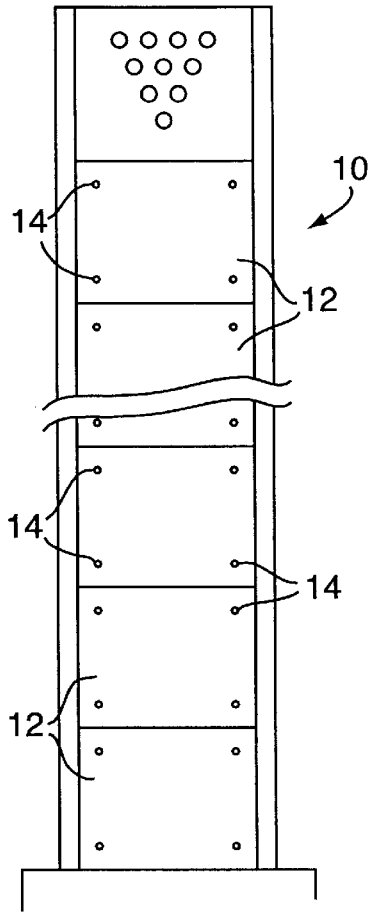
FIG. 1 is a diagrammatic view of a bowling lane.
Figure 2:
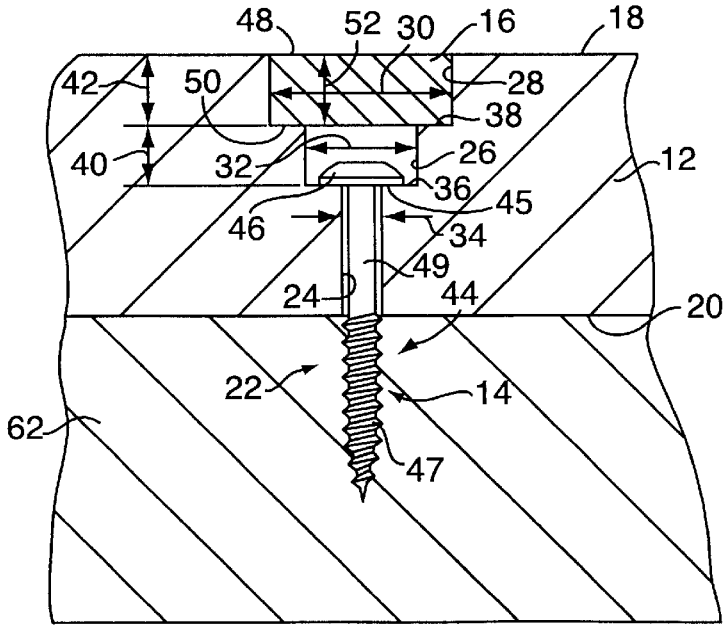
FIG. 2 is a diagrammatic partial sectional view of a bowling lane showing a first attachment site embodiment.
Figure 3:
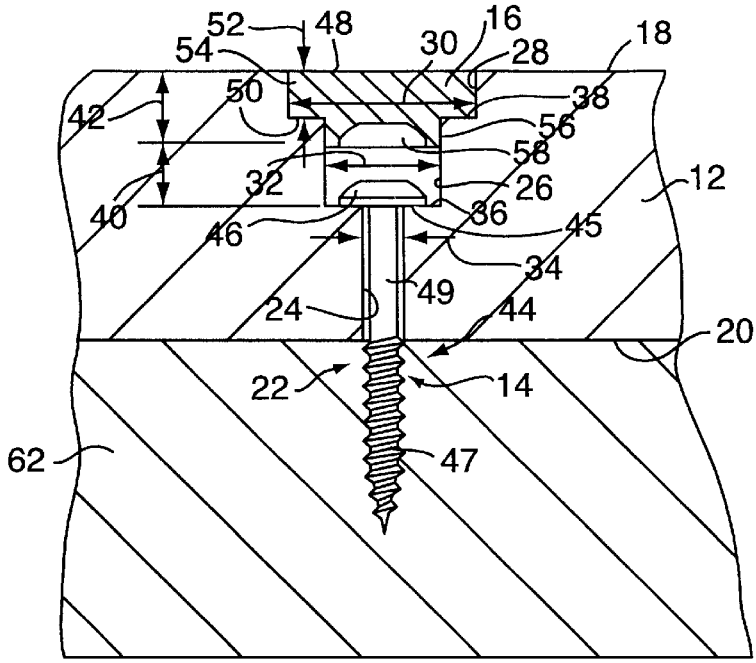
FIG. 3 is a diagrammatic partial sectional view of a bowling lane with the first attachment site embodiment with a second plug embodiment.

Referring to FIGS. 1–3, a bowling lane 10 according to the present invention includes one or more lane sections 12, a plurality of fasteners 14, and a plurality of plugs 16. Each of the one or more lane sections 12 includes a first surface 18, a second surface 20, and a plurality of attachment sites 22. In one embodiment, each attachment site 22 has a first bore 24, a second bore 26, and a third bore 28, all substantially concentric and each having a diameter. The first bore 24 extends between the second surface 20 and the second bore 26. The second bore 26 extends between the first bore 24 and the third bore 28. The third bore 28 extends between the second bore 26 and the first surface 18. The diameter 30 of the third bore 28 is greater than the diameter 32 of the second bore 26, and the diameter 32 of the second bore 26 is greater than the diameter 34 of the first bore 24. A first shoulder 36 extends substantially radially between the first bore 24 and the second bore 26, and a second shoulder 38 extends substantially radially between the second bore 26 and the third bore 28. The second bore 26 has an axial length 40, and the third bore 28 has an axial length 42.

As used herein, the term "diameter" is defined to include the conventional definition of a line across a circular cross-section through the center of that cross-section. In some instances, elements described herein as having a diameter may be non-circular. In those instances, the term "diameter" refers to a line across the non-circular cross-section, in most instances through a center point of the non-circular cross-section.

Figure 4:
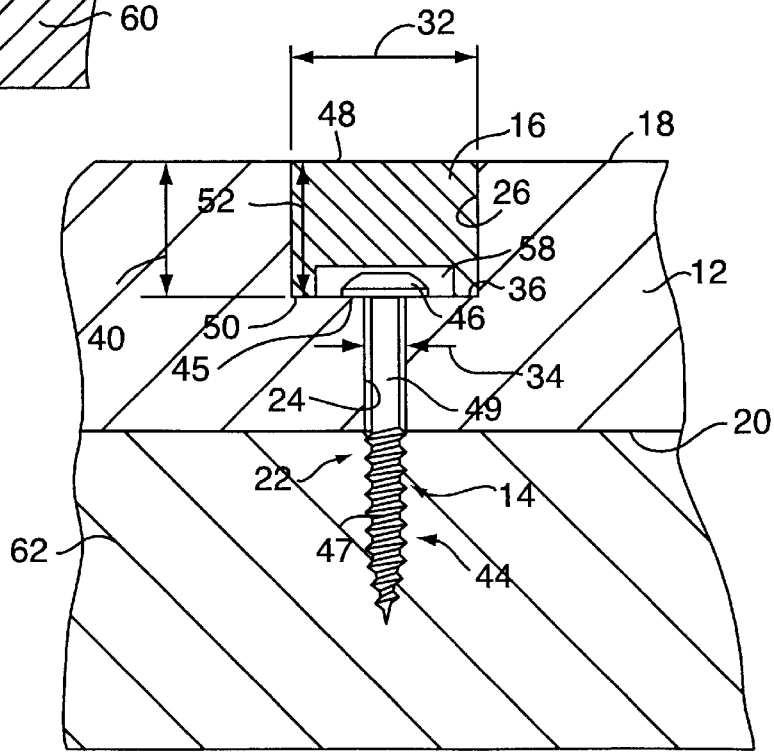
FIG. 4 is a diagrammatic sectional view of a bowling lane showing a second attachment site embodiment.

Each of the plurality of fasteners 14 has a shaft 44 and a cap 46. In a preferred embodiment (see FIG. 2), the shaft 44 includes a threaded portion 47 and an unthreaded portion 49 and the outer diameter of unthreaded portion 49 is smaller than the outer diameter of the threaded portion 47. The threaded portion 47 of the fastener shaft 44 has a diameter that is substantially equal to or less than the diameter of the first bore 24. In the preferred embodiment, the diameter of the threaded portion 47 of the fastener shaft 44 is substantially equal to the diameter of the first bore 24 to facilitate guiding the fastener 14. The smaller diameter of the unthreaded portion 49 provides clearance between the fastener shaft 44 and the first bore 24. The fastener cap 46 has a diameter that is less than the diameter of the second bore 26, thereby providing clearance between the fastener cap 46 and the second bore 26. The cap 46 of the fastener 14 shown in FIGS. 2–4 has an under surface 45 that is flat and extends radially outward in a direction substantially perpendicular to the axis of the shaft 44. The fastener 14 shown in FIGS. 2–4 is a screw type fastener. Other type fasteners can be used alternatively.

Each of the plugs 16 has a top surface 48, a base surface 50, and a cross-sectional geometry that mates with the third bore 28 of an attachment site 22. In some embodiments, a slight press fit between the plug 16 and the third bore 28 maintains the plug 16 within the third bore 28. In other embodiments, a feature (e.g., tab, button, rib, etc.) is employed to maintain the plug 16 within the third bore 28. In other embodiments, a screw thread arrangement between the plug 16 and the third bore 28 maintains the plug 16 within the third bore 28. In other embodiments, an adhesive is employed to maintain the plug 16 within the third bore 28. The axial length 52 of each plug is substantially equal to the axial length 42 of the third bore 28. In an alternative embodiment shown in FIG. 3, a plug 16 has a cap portion 54 that fits within the third bore 28 and a body portion 56 that extends into the second bore 26. The plugs 16 can be made from a variety of materials including, but not limited to, one similar to or the same as the material of the lane sections 12, or a polymer such as polypropylene. In many applications, a polymeric plug 16 is preferred because the material properties of the polymer facilitate a press fit and retention within a bore. In some embodiments, the base surface 50 of the plugs 16 includes a cavity 58 to accommodate the cap 46 of the fastener 14.

Figure 5:
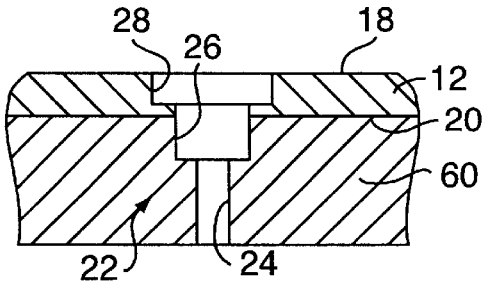
FIG. 5 is a diagrammatic partial sectional view of a bowling lane embodiment.

Referring to FIG. 5, in some embodiments a backing panel 60 is fixedly attached to the second surface 20 of each lane section 12. At least the first bore 24, and possibly the second bore 26, extend into the backing panel 60. The material of the backing panel 60 (e.g., particle board, etc.) can be varied to accommodate the application at hand.

In a new bowling lane application, the lane sections 12 are disposed on top of a substrate 62 that is attached to the structure of the building. The substrate 62 typically consists of a particle board type material. A fastener 14 is inserted into each attachment site 22 and screwed into, or otherwise engaged with, the substrate 22. Once the lane sections 12 are attached, the plugs 16 are installed. The method of installing the plugs 16 depends upon the mechanism used for maintaining the plug 16 within the third bore 28. If, for example, the plug 16 forms a slight press fit with the third bore 28, the plug 16 is tapped into the third bore 28 until the plug 16 abuts the shoulder 36 extending between the second bore 26 and the third bore 28. Because the axial length 52 of the plug 16 is substantially equal to the axial length 42 of the third bore 28, the top surface 48 of the plug 16 is substantially co-planar with the first surface 18 of the lane section 12.

In a resurfacing application, the lane sections 12 are typically disposed on top of the original lane (also referred to as "62"). A fastener 14 is inserted into each attachment site 22 and screwed into, or otherwise engaged with, the original lane 62. Once the lane sections 12 are attached, the plugs 16 are installed as described above.

In both applications, the clearances between the fastener shaft 44 and the first bore 24, and between the fastener cap 46 and the second bore 26, permits lateral movement between the substrate/original lane 62 and the lane sections 12 to accommodate disparate expansion of the two. The substantially radially extending first shoulder 36 disposed between the first bore 24 and the second bore 26 facilitates the lateral movement by providing a surface on which the fastener cap 46 can slide.

Referring to FIG. 4, in an alternative embodiment each attachment site 22 has a first bore 24 and a second bore 26, substantially concentric with one another. The first bore 24 extends between the second surface 20 and the second bore 26. The second bore 26 extends between the first bore 24 and the first surface 18. The diameter 32 of the second bore 26 is greater than the diameter 34 of the first bore 24. A shoulder 36 extends substantially radially between the first bore 24 and the second bore 26. The second bore 26 has an axial length 40. The plurality of fasteners 14 is the same as those described above.

In this embodiment, each of the plugs 16 has a top surface 48, a base surface 50, a cavity 58 disposed in the base surface 50, and a cross-sectional geometry that mates with the second bore 26 of an attachment site 22. The mechanisms for maintaining the plug 16 within a bore (e.g., press fit, feature, screw thread, etc.) are the same as those described above. The axial length of each plug 16 is substantially equal to the axial length 40 of the second bore 26. The cavity 58 disposed in the base surface 50 is large enough to receive the fastener cap 46, including lateral clearance for allowing lateral movement.

Once the lane sections 12 are attached, the plugs 16 are installed substantially as described above except that each plug 16 is installed within a second bore 26. The plug 16 is inserted into the second bore 26 until the plug 16 abuts the shoulder 36 extending between the first bore 24 and the second bore 26. Because the axial length 52 of the plug 16 is substantially equal to the axial length 40 of the second bore 26, the top surface 48 of the plug 16 is substantially co-planar with the first surface 18 of the lane section 12.

The clearances between the fastener shaft 44 and the first bore 24, and between the fastener cap 46 and the cavity 58 of the plug 16, permits lateral movement between the substrate/original lane 62 and the lane sections 12 to accommodate disparate expansion of the two. The substantially radially extending shoulder 36 disposed between the first bore 24 and the second bore 26 facilitates the lateral movement by providing a surface on which the fastener cap 46 can slide.

Although this invention has been shown and described with respect to the detailed embodiments thereof, it will be understood by those skilled in the art that various changes in form and detail thereof may be made without departing from the spirit and scope of the invention.

What is claimed is:

1. A bowling lane for attachment to a substrate, comprising:

one or more lane sections, each having a first surface, a second surface, and a plurality of attachment sites, wherein each attachment site has substantially concentric first, second, and third bores, wherein the first bore has a first diameter, the second bore has a second diameter, and the third bore has a third diameter and a bore axial length, wherein the third diameter is greater than the second diameter, and the second diameter is greater than the first diameter;

a plurality of fasteners, each having a shaft and a cap, wherein the fasteners are disposed within the attachment sites such that the cap is disposed in the second bore, and the shaft extends through the first bore for engagement with the substrate; and a plurality of plugs, each having a pair of end surfaces and a plug axial length, wherein the plugs are disposed in the third bores, and the bore axial length is substantially equal to the plug axial length.

2. The bowling lane of claim 1, wherein in each attachment site the first bore extends between the second surface and the second bore, the second bore extends between the first bore and the third bore, and the third bore extends between the second bore and the first surface.

3. The bowling lane of claim 2, each attachment site further comprises a first shoulder substantially radially extending between the second bore and the third bore, wherein the plug within each third bore abuts the first shoulder.

4. The bowling lane of claim 2, wherein the cap of each fastener has a diameter and that diameter is smaller than the second diameter by an amount that permits lateral movement of the cap within the second bore.

5. The bowling lane of claim 4, wherein the shaft of each fastener has a diameter and that diameter is smaller than the first diameter by an amount that permits lateral movement of the shaft within the first bore.

6. The bowling lane of claim 5, each attachment site further comprises a second shoulder radially extending between the first bore and the second bore, wherein the radially extending second shoulder facilitates lateral movement of the fastener within the attachment site.

7. The bowling lane of claim 5, wherein an interference fit is used to maintain the plugs within the third bores.

8. The bowling lane of claim 5 wherein the plugs are comprised of a polymeric material.

9. A bowling lane for attachment to a substrate, comprising:

one or more lane sections, each having a first surface, a second surface, and a plurality of attachment sites, wherein each attachment site has substantially concentric first and second bores, wherein the first bore has a first diameter and the second bore has a second diameter and a bore axial length, wherein the second diameter is greater than the first diameter, and wherein in each attachment site the first bore extends between the second surface and the second bore, the second bore extends between the first bore and the first surface;

a plurality of fasteners, each having a shaft and a cap, wherein the fasteners are disposed within the attachment sites such that the cap is disposed in the second bore, and the shaft extends through the first bore for engagement with the substrate; and a plurality of plugs, each having a pair of end surfaces, a plug axial length, and a cavity disposed in one of the end surfaces, wherein the plugs are disposed in the second bores, and the bore axial length is substantially equal to the plug axial length.

10. The bowling lane of claim 9, each attachment site further comprises a shoulder substantially radially extending between the first bore and the second bore, wherein the plug within each second bore abuts the shoulder.

11. The bowling lane of claim 10, wherein the cap of each fastener has a diameter and that diameter is smaller than the cavity by an amount that permits lateral movement of the cap within the second bore; and wherein the shaft of each fastener has a diameter and that diameter is smaller than the first diameter by an amount that permits lateral movement of the shaft within the first bore.

12. A bowling lane for attachment to a substrate, comprising:

one or more lane sections, each having a first surface, a second surface, a plurality of attachment sites, and a backing panel fixedly attached to the second surface, wherein each attachment site has substantially concentric first, second, and third bores, wherein the first bore has a first diameter, the second bore has a second diameter, and the third bore has a third diameter and a bore axial length, wherein the third diameter is greater than the second diameter, and the second diameter is greater than the first diameter, and wherein in each attachment site the first bore extends within the backing panel;

a plurality of fasteners, each having a shaft and a cap, wherein the fasteners are disposed within the attachment sites such that the cap is disposed in the second bore, and the shaft extends through the first bore for engagement with the substrate; and a plurality of plugs, each having a pair of end surfaces and a plug axial length, wherein the plugs are disposed in the third bores, and the bore axial length is substantially equal to the plug axial length.

13. An apparatus for resurfacing an existing bowling lane, comprising:

one or more lane sections, each having a first surface, a second surface, and a plurality of attachment sites, wherein each attachment site has substantially concentric first, second, and third bores, wherein the first bore has a first diameter, the second bore has a second diameter, and the third bore has a third diameter, wherein the third diameter is greater than the second diameter, and the second diameter is greater than the first diameter, and wherein in each attachment site the first bore extends between the second surface and the second bore, the second bore extends between the first bore and the third bore, and the third bore extends between the second bore and the first surface;

wherein the one or more lane sections are attachable to the existing bowling lane by fasteners, each having a shaft and a cap, wherein the fasteners are disposed within the attachment sites such that the cap is disposed in the second bore, and the shaft extends through the first bore for engagement with the substrate; and wherein each third bore is sized to receive a plug.

* * * * *

UNITED STATES PATENT AND TRADEMARK OFFICE

CERTIFICATE OF CORRECTION

PATENT NO. : 6,645,082 B1 
DATED : November 11, 2003
INVENTOR(S) : Timothy F. Lessard et al.

It is certified that error appears in the above-identified patent and that said Letters Patent is hereby corrected as shown below:

Title page,
Item [73], Assignee, should read as follows:
-- [73] Assignee: Panolam Industries International Incorporated, Shelton, CT (US) --

Signed and Sealed this

Twenty-seventh Day of January, 2004

JON W. DUDAS
*Acting Director of the United States Patent and Trademark Office*